United States Patent [19]

Daniels

[11] 4,342,603

[45] Aug. 3, 1982

[54] CRYSTALLINE GLUCOSE AND PROCESS FOR ITS PRODUCTION

[75] Inventor: Michael J. Daniels, Reading, England

[73] Assignee: Tate & Lyle Limited, England

[21] Appl. No.: 237,645

[22] Filed: Feb. 24, 1981

[30] Foreign Application Priority Data

Feb. 27, 1980 [GB] United Kingdom ..... 8006661

[51] Int. Cl.[3] ..... C13K 1/10

[52] U.S. Cl. ..... 127/30; 127/58; 127/61

[58] Field of Search ..... 127/58, 30, 38

[56] References Cited

U.S. PATENT DOCUMENTS 4,059,460 11/1977 Schdlmeier ..... 127/58 X

*Primary Examiner*—Sidney Marantz

*Attorney, Agent, or Firm*—Ostrolenk, Faber, Gerb & Soffen

[57] ABSTRACT

A product comprising a mixture of $\alpha$- and $\beta$- forms of glucose as microcrystals, at least 70% of the glucose being in the form of the $\beta$-isomer, dissolves readily in water to give approximately 60% solids solutions at ambient temperature. It is obtained by a process comprising the steps of (1) evaporating water from syrup at a pressure of less than 400 mm Hg to provide an at least 60% supersaturated solution of greater than 95% solids at a temperature of from 95° to 140° C.;

(2) subjecting the supersaturated solution substantially instantaneously to a shear force to cause immediate nucleation of the syrup without cooling; and (3) immediately forming the nucleated but substantially uncrystallized syrup into a quiescent layer and allowing the layer to crystallize substantially isothermally to produce solid crystalline glucose.

13 Claims, 5 Drawing Figures

50 μ

50μ

50μ

Temp °C.
130
120
110
100
90
94
95
96
97
98
99
% Solids
(zero)
(70)
(75)
(80)
(90)
Setting time (min) Ca.100 DE
Setting time (min) Ca.97 DE
Supersaturation. (%)

CRYSTALLINE GLUCOSE AND PROCESS FOR ITS PRODUCTION

The present invention relates to the production of crystalline glucose.

Glucose is currently available as syrup or in solid form. Solid D-glucose is also known as dextrose. D-glucose exists in two main forms: the α-D-pyranose and the β-D-pyranose forms, known as α-D-glucose and β-D-glucose. An aqueous solution of either form of glucose exhibits the phenomenon of mutarotation, in which an equilibrium mixture of the two forms is slowly achieved.

Glucose syrup is obtained from starch by acid or enzyme hydrolysis and comprises D-glucose together with varying amounts of maltose and maltodextrins. The amount of glucose varies with the degree of starch conversion and is expressed as a dextrose equivalent or DE value. The DE is the total amount of reducing sugars expressed as dextrose which is present in the syrup, calculated as a percentage of the total dry substance. The high DE syrups, which contain the higher amounts of glucose and other reducing sugars, are used primarily to sweeten foods, while the low DE syrups are principally used to thicken soft drinks and to give them body. There are many other uses for the glucose syrups.

It is a disadvantage of glucose syrups that the glucose and other sugars contained therein tend partially to crystallize when stored at ambient temperature. As such, the usual practice is to store glucose syrups at above ambient temperature; however, with the passage of time it is found that unwanted brown coloration develops in the syrup.

As alternatives to the glucose syrups, there are two solid forms of glucose which are commercially available for use in foods and other products.

There is a crystalline monohydrate of α-D-glucose, otherwise known as dextrose monohydrate, for example the product sold as "Meritose" (Registered Trade Mark). It is obtained by crystallization of an aqueous solution at a relatively low temperature (e.g. about 40° C.). This product suffers from the disadvantgage that the crystals are relatively large and slow dissolving: it can take some two or three days to produce a solution with as high a solids content as might be wanted for use in the manufacture of foods and drinks. An additional disadvantage is that dextrose monohydrate is slow to produce by crystallisation. Mutarotation in the solution means that a mixture of α- and β-forms are present, but only the α form can crystallise as monohydrate. This means that the equilibrium has to shift as α-D-glucose crystallises and this slows down the rate of crystal production.

The other commercially available form of solid glucose is anhydrous glucose, generally in the form of a spray-dried product obtained from a glucose syrup, e.g. from a 40 DE syrup. It is relatively difficult matter to produce this spray-dried product, and as such it is expensive. The glucose content of the spray-dried material is predominantly α-D-glucose, but it is present in a glassy form which is hygroscopic and hence difficult to handle because of caking.

The only other form of solid D-glucose possible is anhydrous β-D-glucose (the β-isomer forms no hydrate). This is theoretically obtainable from concentrated syrups at high temperatures. Such a crystallisation is difficult to control as the crystals must be separated at the high temperature or contaminating α-D-glucose and the monohydrate are formed.

The only really important commercial form of solidified glucose presently available is αD-glucose monohydrate. Various processes have been proposed for other products but none has met with much commercial success. For example, U.S. Pat. No. 2,324,113 of American Maize Products Co. describes the formation of a syrup of about 50–87% solids which is heated to 93°–137° C. and spray dried by atomisation in an air stream at 60° C. to obtain glassy particles of a 50:50 mixture of α- and β-dextrose (no mutarotation). (All references to concentration are in % by weight).

U.K. Application No. 2,010,325A of Ingredient Technology Corporation shows a modification of this in which droplets of syrup of at least 75% solids at above 121° C. are sprayed into a cooler gas which is used to transport the solidifying particles. U.S. Pat. No. 3,477,874 of Kroyer and A/S Niro Atomizer describes the adaption of the spray drying process in which a major portion of the solidified material is recycled to the spray head. A closely related process is described in U.K. Pat. No. 1,386,118 of W. R. Grace and Co. Also, U.S. Pat. No. 3,567,513 of A/S Niro Atomizer describes a modification in which the recirculated solid is contacted with a saturated glucose solution before being sprayed.

An alternative to this type of spray drying is described in U.S. Pat. No. 3,239,378 of Corn Products Co., where an 88–98% solids "liquor" is sprayed at 107°–150° C. onto a bed of seed glucose at 10°–40° C. being constantly agitated. The solidified material is then cooled and dried in an air stream. This process also produces an approximately 50:50 mixture of α- and β-D-glucose. An earlier process based on the same principle is described in U.S. Pat. No. 2,369,231 of Corn Products Refining Co.

All of these processes appear to produce a glucose product which is at least half α-D-glucose, in the form of particles of crystal/glass mixtures. Spray drying and spray drying with seed addition are complicated processes which are difficult to control and which require elaborate machinery.

A different approach is described by A. E. Staley Manufacturing Company in U.S. Pat. No. 3,197,338 in 1965. This process involves the formation of a high-solids glucose syrup by vacuum evaporation to less than 5% water. This hot syrup is then slowly kneaded and worked without cooling until at least 45% of the glucose present has crystallised, i.e. for a matter of minutes, and is then rapidly cooled and ground up. The kneading is described as necessary, since otherwise the syrup would simply solidify as a glassy product. Typically, a kneading machine is used at about 50 rev/minute. The temperature and residence time in the kneading device must be carefully controlled to minimise heat damage to the product and yet to achieve the desired crystallinity. The temperature is preferably below 230° F. (110° C.) which would be expected to produce a high proportion of α-D-glucose as the phase boundary between α- and β is about 113° C. The rapid cooling required is provided by air blasts.

This process requires careful control, especially during the heating phase, and produces a product which is about 50–80% crystalline and presumably contains a major proportion of α-D-glucose. This process does not seem to have been successful, as twelve years later Staley, in U.S. Pat. No. 4,059,460, disclosed a different process which is described as being more effective. In this later process, a syrup containing no more than 93% solids is simultaneously sheared and cooled to a temperature below 200° F. (93.4° C.) to form a viscous fluid mass which is then crystallised in a thin layer on a belt, typically over about 4 minutes. The product is then dried, typically for about 4 hours in a rotary air dryer. The product contains from 15–60% β-D-glucose and 85–40% α-D-glucose. High solids content syrups are avoided because of premature solidification, adverse flavour and colour formation, non-uniformity in drying, and excessive viscosities. Thus, the later process substitutes a short period of shearing in place of a longer period of kneading, but this applied to a lower solids syrup so that a long drying period is required. The temperatures chosen give no more than 60% β-D-glucose.

We have now found that microcrystalline glucose with a high β-content is a very useful product, in that it dissolves readily and quickly, and is not hygroscopic and prone to caking.

In accordance with the present invention, there is provided a novel form of glucose comprising a mixture of α- and β-forms as microcrystals of D-glucose, at least 70% of the glucose being in the form of the β-isomer. In a preferred form, at least 85% of the glucose is present as the β-isomer. Although the microcrystals may form part of an agglomerate or other composite structure, the microcrystals typically each have a maximum dimension of less than 50μ, more usually less than 10μ.

The present novel form of glucose has many advantages and can be produced on an industrial scale by a novel process.

Thus, according to the present invention, there is also provided a process for the production of crystalline glucose from a glucose syrup, comprising the steps of evaporating water from the syrup at a pressure of less than 400 mm Hg to provide an at least 60% supersaturated solution of greater than 95% solids at a temperature of from 95° to 140° C.; subjecting the supersaturated solution substantially instantaneously to a shear force to cause immediate nucleation of the syrup without cooling; and immediately forming the nucleated but substantially uncrystallised syrup into a quiescent layer and allowing the layer to crystallise substantially isothermally to produce solid crystalline glucose.

The degree of supersaturation referred to herein is defined as the amount of glucose which would crystallise out of a solution at constant temperature (i.e. to reduce the solution to a saturated solution at that temperature) expressed as a percentage of the total amount of glucose in the solution. It is preferably at least 70%, most preferably at least 80%.

It is an essential and especially noteworthy feature of the present invention that the shear force to which the syrup is subjected acts substantially instantaneously. In a preferred method, the shear is applied by passing the syrup through a high-speed, low-clearance mill or homogeniser, such as a colloid mill, for example a Fryma toothed colloid mill, with a residence time of from 0.05 to 0.5 second, e.g. about 0.1 to 0.25 second. Such a mill can provide a velocity gradient of from 8,000 to 30000 cm/sec/cm. In another mode of operation, the syrup may simply be forced through a restricted nozzle, e.g. of 0.3 to 0.7 cm internal diameter giving a maximum velocity gradient of about 3,000 cm/sec/cm for a residence time of about 0.05 to 0.1 second. In general, the term "substantially instantaneous" thus means for less than 0.5 second, preferably for less than 0.25 second. The shear force should be enough to nucleate the syrup sufficiently to allow rapid crystallisation, and a typical velocity gradient range is from 1000 to 100,000 cm/sec/cm, preferably 3,000 to 80,000 cm/sec/cm. The upper end of the range is obtainable, for example, with an in-line homogeniser, such as a Silverson mixer.

In the substantially instantaneous shearing, the syrup does not cool. Indeed, the high energy input of a device such as a colloid mill leads instead to heating and the post-shear temperature is typically several degrees Celsius higher than the pre-shear temperature. However, the application of shear is of such a short duration that overheating and degradation are not a problem.

The nucleated syrup is then formed into a quiescent layer to crystallise. It will be understood that the crystallisation is exothermic so heat must be given off to avoid degradation. To expose the syrup to the air and to maintain the syrup in a quiescent state, i.e. completely unbeaten, the syrup is conveniently allowed to flow onto a flat moving conveyor, where it can set solid while being moved away from the apparatus providing the shear. A steel or reinforced plastics band is particularly suitable. It will be understood that the syrup is removed from the shearing apparatus, e.g. the colloid mill, in a form which is substantially uncrystallised. There is thus little risk of crystallisation causing blockages in the apparatus provided that the flow rate and temperature are controlled. The syrup is crystallised in a layer which is suitably from 1 to 2 cm thick. The major part of the crystallisation is substantially isothermal, i.e. occurs at substantially constant temperature until the supersaturation is zero. Subsequent cooling then results in extra solidification which typically involves a proportion of both glass-formation and crystallisation, depending on the DE value of the syrup.

An assembly of apparatus of this type is disclosed in U.K. Pat. No. 1,460,614 which is concerned with the "transformation" of sucrose. In that process, sucrose syrups at about 90% solids are catastrophically and homogeneously nucleated by exposure to a shear force with a velocity gradient of at least 5000 cm/sec/cm and discharged onto a conveyor. The nucleated syrup then undergoes an exothermic crystallisation at a temperature (typically 125° C.) at which the water content is boiled off to give an open, essentially microcellular product, the texture being caused by the blowing effect of the boiling water. Thus, a syrup with a relatively high water content (9–10%) and a correspondingly low viscosity (ca.2 poises) can be thoroughly nucleated and will crystallise while driving off the water. This process is known as "transformation".

The transformation process is impossible to apply to glucose. This is because the boiling point of a high solids content glucose syrup is always above the saturation point. In other words, a glucose solution of a given solids content will have a boiling point at a temperature above the temperature at which the solution is saturated (or, the temperature at which the glucose will crystallise). It will thus be seen that if the crystallisation temperature is always below the boiling point, transformation, at least at atmospheric pressure, is impossible. For this reason, glucose syrups have always been evaporated to a virtually dry state before solidification or have been crystallised wet, with subsequent long and tedious drying procedures. It has also been found in the past that very high solids content glucose syrups have tended to form glasses rather than crystallise unless they were either beaten for minutes, as in the Staley processes, or heavily seeded. It is therefore highly surprising that a very viscous (Ca. 13 poises), high solids content glucose syrup can be treated like a 90% solids transformable sucrose syrup and can be nucleated instantaneously by colloid milling, or even by simple extrusion, to an extent sufficient to preclude glass-formation.

The speed of crystallisation is particularly surprising and may perhaps be related to the physical form of the glucose. Without wishing to be bound by theoretical considerations, it appears that the conditions of the present invention lead to a product which is largely β-D-glucose and this crystallises very rapidly. The crystallisation is, in fact, so rapid on occasions that experimental runs were ruined by crystallisation of syrup which had passed through a narrow orifice, while the syrup was still in the pipework. For this reason, it is essential that once the correct solids content and temperature have been obtained that the syrup is discharged onto the conveyor immediately after it has been sheared. Constriction or sharp bends or other shear-producing configurations should not be included in the system upstream of the chosen shear device.

The present process is widely applicable to the crystallization of glucose syrups of high DE, e.g. 93 to 100 ED. Evaporation at less than 400 mm Hg is employed to raise the concentration to at least 95% solids. In practice, the process gives its best results when solutions of 98 to 99% solids are prepared from syrups of 97 to 100 DE. Preferably the pressure will be below 300 mm Hg and most preferably below 150 mm Hg. A pressure of about 125 mm Hg is particularly advantageous.

While syrups of various DE values can be used in the process of this invention, in general it is best to use a syrup with as high a DE as possible as this leads to a more highly crystalline product. The presence of dextrins, etc., in lower DE syrups increases the glass content of the product. In general, a DE value of at least 93 is desirable, most preferably 97–100 as stated above. For a very high DE syrup (e.g. about 100), pure dextrose monohydrate can be dissolved in water and evaporated to the required solids content and temperature. In this way, the process converts slowly dissolving macrocrystalline dextrose monohydrate into a fast dissolving microcrystalline, predominantly β-D-glucose product.

In effecting the evaporation, there is observed an unexpected increase in the boiling point of the glucose solution. More specifically, the observed boiling point is above the boiling point calculated in accordance with the Duhrings Principle and using Washburn and Reed's equation (see "Calculating the Boiling Points of Glucose Syrup "by George Alton in Confectionery Manufacture and Marketing, December 1966). It is a feature of a preferred process of the present invention that the observed boiling point under "steady state" conditions is at least 4° C. above the calculated boiling point, with the optimum difference being around 7° to 8° C.

It is not possible to predict in isolation the boiling point increase which will be observed. The increase depends not only on the pressure below 400 mm Hg which is adopted, but also on the syrup which is employed. It also follows that the actual boiling point cannot be determined a priori.

Accordingly, it is not possible to lay down precise operating temperatures for the evaporation step. For solutions of dissolved dextrose monohydrate, the temperature should preferably be from 110° to 130° C., with 115° to 125° C. being more preferred. On the other hand, for less pure glucose-containing solutions the temperature should preferably be from 105° to 125° C., with 110° to 120° C. being more preferred. Such boiling points can readily be obtained at pressures of 100 to 150 mm Hg. In general, for a given syrup the higher the boiling point the higher the β-content of the product, up to a maximum β-content determinable by experiment.

After the evaporation step, the resultant syrup of at least 95% solids is subjected to shear. Particularly for prolonged continuous operation, the process is preferably operated so as to attain "steady state" conditions, whereby the temperatures of the syrup in the evaporator and in the equipment used to apply the shear remain constant and the same. It is further preferred that a similar constant temperature is attained in the crystallizing mass in which nucleation has been induced.

There appears to be an unexpected advantage in that minimum crystallisation times, e.g. 1 to 5 minutes, are obtained when the temperature of the crystallising mass is from 112° to 130° C. for high DE syrups, e.g. made from dissolved dextrose monohydrate, and from 100° to 120° C. for less pure syrups. It will be appreciated that these temperatures for short crystallisation times are substantially the same as the preferred boiling points employed in the evaporation step.

The present invention will now be described by way of example.

A suitable glucose syrup is first prepared. The syrup has to be evaporated to a solids content of at least 95% by weight, and preferably to at least 98% solids. The solids should essentially comprise glucose. In particular, the solids should be at least 90% glucose or more preferably more than 97% glucose.

Usually the syrup required for the present process will be prepared by first forming a dilute syrup and then concentrating it in stages to the appropriate concentration. There also appears to be some advantage in starting with a relatively dilute solution before evaporation, e.g. 20–45% solids. The dilute syrup can be obtained by dissolving dextrose monohydrate, but it is more economic if use is made of the high DE syrups obtained by acid and/or enzyme hydrolysis of starch.

Before a dilute glucose solution is concentrated by evaporation, it is greatly preferred to adjust the pH to minimize degradation during the subsequent heating. A pH of from 3 to 5 is normally used, with a pH of about 4 being preferred.

The dilute solution can be concentrated in conventional equipment, e.g. using a plate heat exchanger with separator or a scraped film evaporator. As mentioned above, the pressure is suitably from 100 to 150 mm Hg, with the temperature then being that required ultimately to give 95% solids or higher. Since colour production is related to the temperature, it is usually more convenient to use as low a temperature as possible, commensurate with maintaining the continuance of the overall process and meeting the desired product specification. For preference, the evaporation is effected in stages, e.g. a first evaporation to about 80% solids and then a second evaporation to the desired 95% or higher solids. The shear force can then be applied using a colloid mill, though this is not essential as explained earlier.

The preferred shear force is in the range 1,000 to 100,000 cm/sec/cm. Particularly for the lower shear forces, it is possible to pump the concentrated syrup through a restricted nozzle in order to apply the shear force. As a result of the application of the shear forces, virtually instantaneous nucleation of the glucose is induced. The resulting substantially uncrystallised mass is discharged on to a belt from the equipment used to apply the shear force. Suitably the mass is discharged to a depth of about 1 to 2 cm on the belt; crystallisation then takes from 4 to 20 minutes.

The crystalline product is an agglomerated mass of microcrystals, sometimes set in a matrix of uncrystallized material. For most purposes, this agglomerated mass is broken up or otherwise reduced in size to produce a free-flowing solid suitable for bagging in sacks. In a typical embodiment, the mass is initially broken up by a roller at the end of the belt and then further comminuted using a kibbler, rotating granulator or other means.

In practice, a convenient way to perform the present process is take a dilute syrup and evaporate it at the maximum vacuum obtainable with the available equipment until say 96% solids is achieved. The concentrated syrup is then subjected to maximum shear with the available equipment. Nucleation should then ensue, though sometimes the time for complete crystallisation may be undesirably long. Thereafter the process can be optimized, e.g. by altering the solids content of the evaporated syrup.

The crystalline product which can be obtained by the process is a novel form of substantially anhydrous glucose, comprising at least 70% β-D-glucose, in the form of an agglomerate of microcrystals or a composite agglomerate comprising a major proportion of microcrystals distributed through a matrix of a minor proportion of uncrystallised, glassy material.

The simple agglomerates are obtained when using glucose syrups of high purity i.e. haviing a DE of over 98%, e.g. syrups produced by dissolution of dextrose monohydrate. The composite agglomerates are obtained when using glucose syrups of lower purity, i.e. having a DE of, say, 92–98%, e.g. syrups produced by hydrolysis of starch. In general, the purer the syrup, the more crystalline will be the product.

Although the size of the agglomerates is limited only by equipment constraints, the microcrystals themselves usually each have a maximum dimension of less than 10 microns. The microcrystals are regular in shape, white when in bulk, and more than 70% by weight of them are of the β-isomer of D-glucose.

Most surprisingly, we find that the β-content of the microcrystals typically tends to be lower for the products obtained from higher purity syrups, e.g. dextrose monohydrate solutions, than it is for the products obtained from syrups of lower purity. For instance, dissolved "Meritose" normally gives an agglomerate of microcrystals in which 75 to 80% of the product is β-D-glucose, whereas a starch hydrolysate of 97 DE normally gives a composite agglomerate wherein from 85 to 90% of the product is β-D-glucose.

The small size of the crystals provided by the invention, and the fact that most are of β-D-glucose, mean that they dissolve rapidly, much faster than glucose monohydrate, and readily give a solution of up to 60% solids.

The properties of a typical product of the invention prepared from a high DE syrup (dissolved glucose monohydrate) were investigated in comparison with conventional products.

1. Dissolution 60 g of the product of the invention were mixed with 40 ml of water at about 20° C. and the resultant slurry stirred. After two minutes, the amount of dissolved material was measured. In comparison, 60 g samples of the product "Meritose" and of a commercially available spray-dried dextrose (containing about 40% α and 60% β) were each similarly stirred with 40 ml of water and the amount of material dissolved after 2 minutes was measured. After 2 minutes, a solution of about 57% solids was obtained with the product of the invention. In contrast, "Meritose" gave a solution of about 26% solids, and the spray-dried dextrose gave a solution of about 47% solids. In other words, the present product readily gave a solution with high dissolved solids content, whereas the prior art products did not.

2. Specific Rotation

The initial specific rotations of solutions of dextrose monohydrate, anhydrous dextrose (prepared by spray-drying) and the present product were determined by plotting the specific rotation of each solution against time and extrapolating to zero time. Whereas the present product had an initial specific rotation $[\alpha]_D^{20}$ of about 40°, both the conventional products had specific rotations of around 110° (all quoted specific rotations being positive). In that the specific rotations for α-D-glucose and β-D-glucose are about 112° and 18°, respectively, it will be apparent that the product of the present invention, at 40°, is mainly β-D-glucose and that the commercially available products are mainly α-D-glucose. An approximate calculation suggests that the present product is, in fact, 75 to 80% β-D-glucose. The proportion of β-isomer in the present product (y%) is given approximately by the formula:

$$18y+112(100-y)=40\times 100$$

from which y is about 77.

3. Electron microscopy

FIGS. 1 and 2 respectively of the accompanying drawings are microphotographs of the present product prepared from "Meritose" and of "Meritose" itself.

It will be seen that whereas "Meritose" includes relatively large crystals, the present product (which was produced from dissolved "Meritose") comprises only agglomerated microcrystals.

FIG. 3 of the accompanying drawings is a microphotograph of a further product of the present invention, this product having been obtained from a 97 DE syrup. It will be seen that the product comprises a composite agglomerate comprising a major proportion of microcrystals bound together by a matrix of a minor proportion of uncrystallised, glassy material.

Specific examples embodying the invention and using the procedure described above are as follows:

EXAMPLE 1

Dextrose monohydrate was dissolved in demineralised water to give a 29% solids solution and adjusted to pH 4. This solution was evaporated to 98.8% solids using a plate heat exchanger/vacuum separator, the vacuum being adjusted to about 125 mm Hg to give a liquor temperature of 122° C. post-separator. This liquor was sheared and nucleated using a "Fryma" colloid mill set for maximum shear (say 25,000 to 30,000 cm/sec/cm). The crystallising liquor was deposited on a stainless steel belt with rubber retaining walls, deposition being to a depth of approx 1 cm. After about 3 minutes the product had set solid. After a total of 17 minutes, the solid cake was granulated through an "Apex" granulator fitted with a stainless steel mesh and sieve-separated to a size of less than 0.5 mm. The product was found to contain 79% of β-D-glucose, about 1% water and had a colour of 65 m.a.u. at 420 nm and pH 4.7. 60 g of the product mixed with 40 g water at 20° C. gave an approximately 57% solids solution after 2 minutes. An equilibrium relative humidity isotherm showed that at 80% humidity the product absorbed only 2% water.

EXAMPLE 2

A commercial low-ash 95 DE glucose syrup was diluted to 40% solids and adjusted to pH 4. This solution was evaporated to 98.5% solids using a plate heat exchanger/vacuum separator, the vacuum being adjusted to give a liquor temperature of 105° C. post-separator. This liquor was nucleated by forcing it through an 0.45 cm ID nozzle at a flow rate of 1.3 kg/min (which gives a calculated shear rate of approx 3000 cm/sec/cm). The crystallising liquor was deposited to a depth of approx 1 cm on a stainless steel belt with rubber retaining walls; the overall residence time on the belt was 8 mins. The solid cake was rough-broken using a "Kek Kibbler", granulated using an "Apex" granulator fitted with a stainless steel mesh, and sieve-separated. The product contained 85% β-D-glucose, about 1.1% water and had a colour of 228 m.a.u. at 420 nm and pH 4.7. The product dissolved at the same rate as the product of Example 1.

EXAMPLE 3

A commercial 93 DE glucose syrup was diluted to 20% solids and adjusted to pH 4. This solution was evaporated to 98.3% solids using a plate heat exchanger/vacuum separator, the vacuum being adjusted to give a liquor temperature of 112° C. post-separator. This liquid was sheared and nucleated using a "Fryma" colloid mill set for maximum shear as before. The crystallising liquor was deposited as before on a belt to a depth of about 1 cm. The total residence time was about 15 minutes. The resultant solid cake was granulated and sieved. The product contained about 85% β-D-glucose, about 1.3% water and had a colour of 445 m.a.u. at 420 nm and pH 4.7. The product also dissolved at about the same rate as the product of Example 1.

EXAMPLE 4

Dextrose monohydrate was dissolved in demineralized water to give a 40% solids solution and adjusted to pH 4.0. This was evaporated to 99% solids in two continuous stages by using plate heat exchangers and vacuum separators. A liquor temperature of 115° C. and an 85% solids solution was obtained as the first stage. A liquor temperature of about 120° C. and a 99% solids solution was obtained on the second stage. The evaporated liquor was sheared and nucleated using a "Fryma" colloid mill set for maximum shear (say 25,000–30,000 cm/sec/cm). The post-mill temperature was up to 135° C. The crystallising liquor was deposited on a stainless steel conveyor belt with a rubber retaining wall, deposition being to a depth of 1.5 cm. After a 6 minute residence on the belt, the solid cake was granulated through an "Apex" granulator fitted with a stainless steel mesh and sieve-separated. This product contained 82% β-D-glucose, about 1% water and had a colour of 100 m.a.u. at 420 nm. and pH 4.7.

EXAMPLE 5

A series of experiments was carried out using both dissolved dextrose monohydrate and a commercial high DE syrup. The respective syrups were adjusted to pH 4 and concentrated in a plate heat exchanger/vacuum separator using an applied vacuum of 25 inches of mercury, corresponding to a pressure of about 125 mm Hg. The syrups were concentrated to various solids contents, and thus the temperature varied. The boiling point elevation was determined.

As in Example 1, the concentrated syrups were then sheared and nucleated using a colloid mill, the crystallising liquor deposited on a belt, and the setting time determined (i.e. the minimum time for sufficient crystallisation to give an agglomerated product which could be granulated and further processed).

The results for the various experiments were plotted as shown in FIGS. 4 and 5 of the accompanying drawings, in which.

Figure 1:
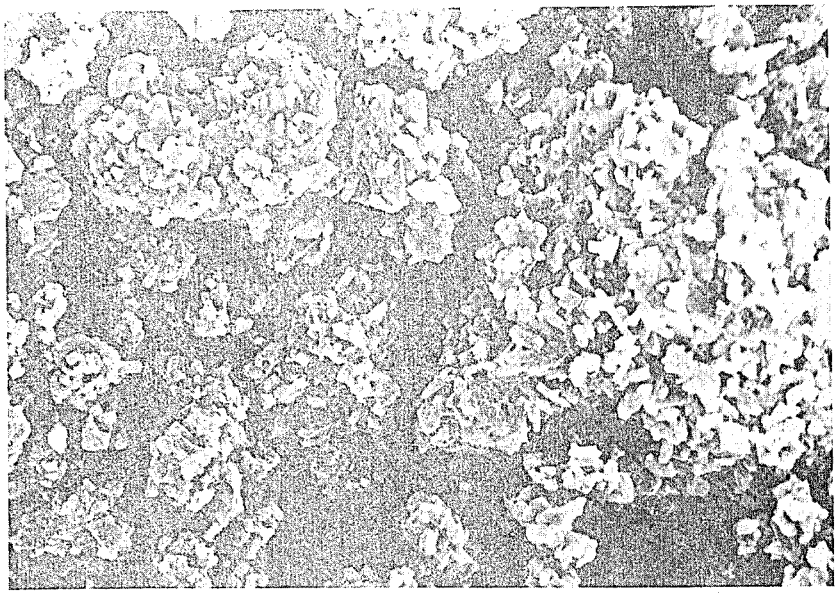
Figure 2:
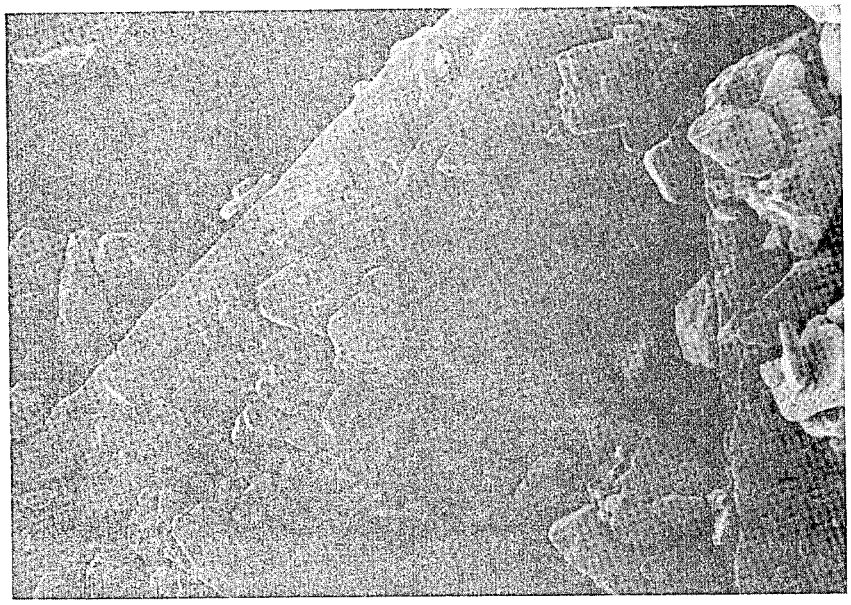
Figure 3:
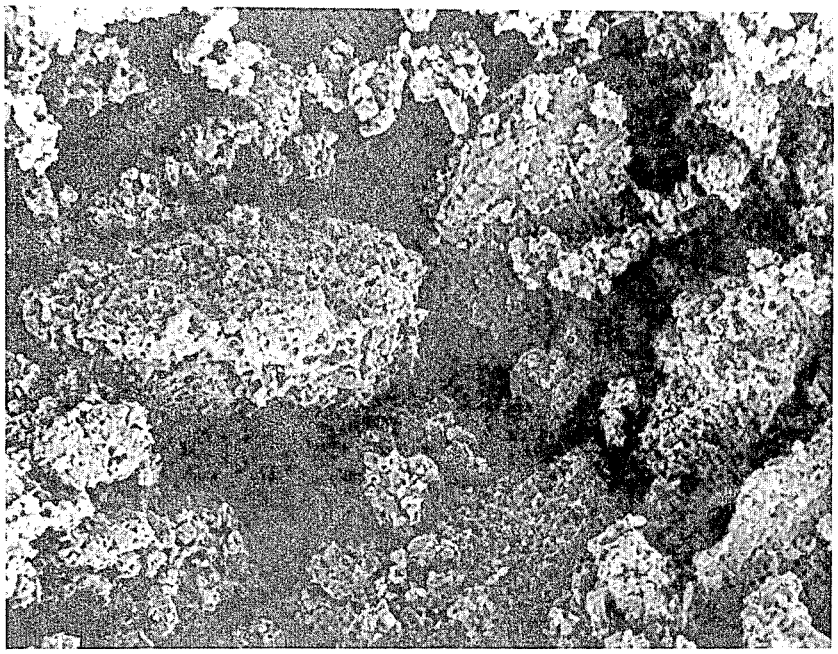
Figure 4:
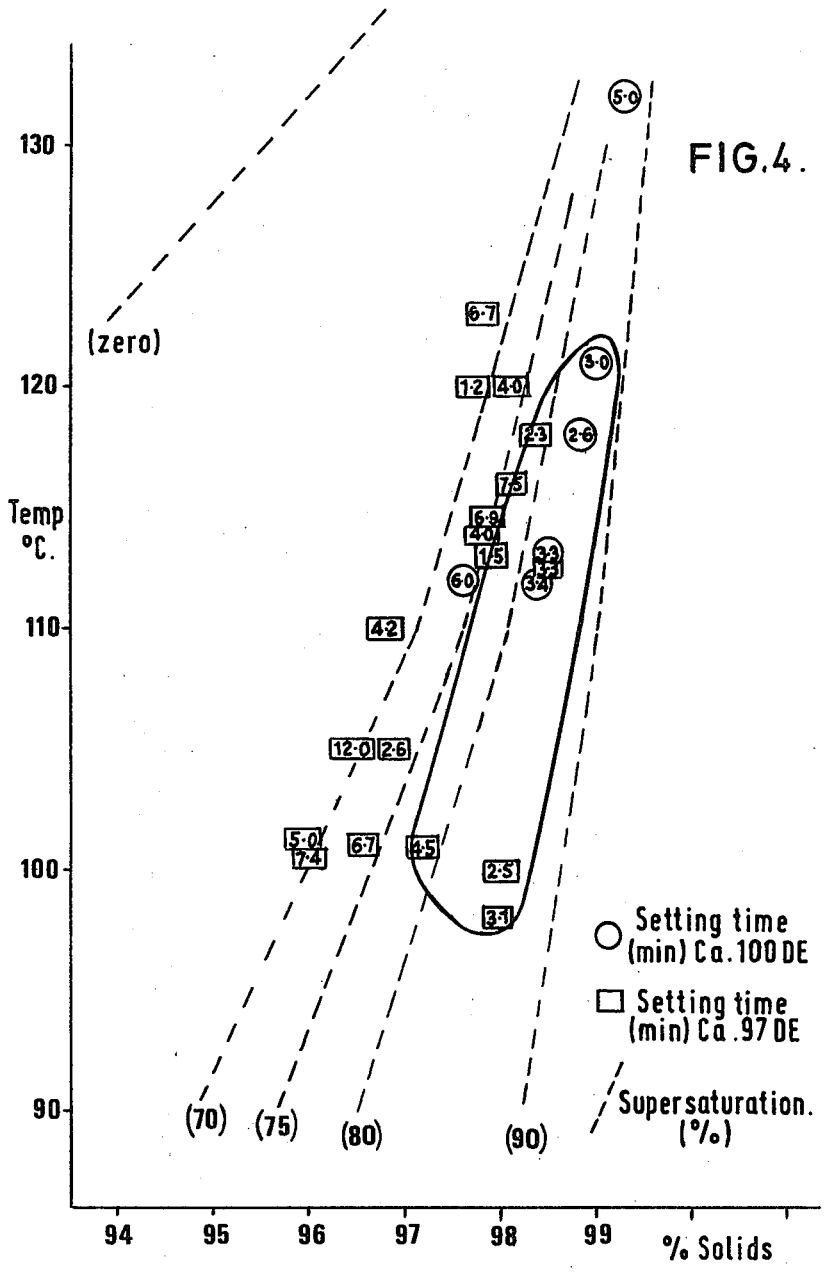
FIG. 4 is a plot of temperature against solids content in which the points are marked with their minimum set times. Also plotted in broken lines are % supersaturation curves.

From FIG. 4, it will be seen that acceptable solidification can be obtained above 60% supersaturation and that the region giving low set times lies approximately within the encircled area between 75 and 90% supersaturation and from 98° to about 122°.

Figure 5:
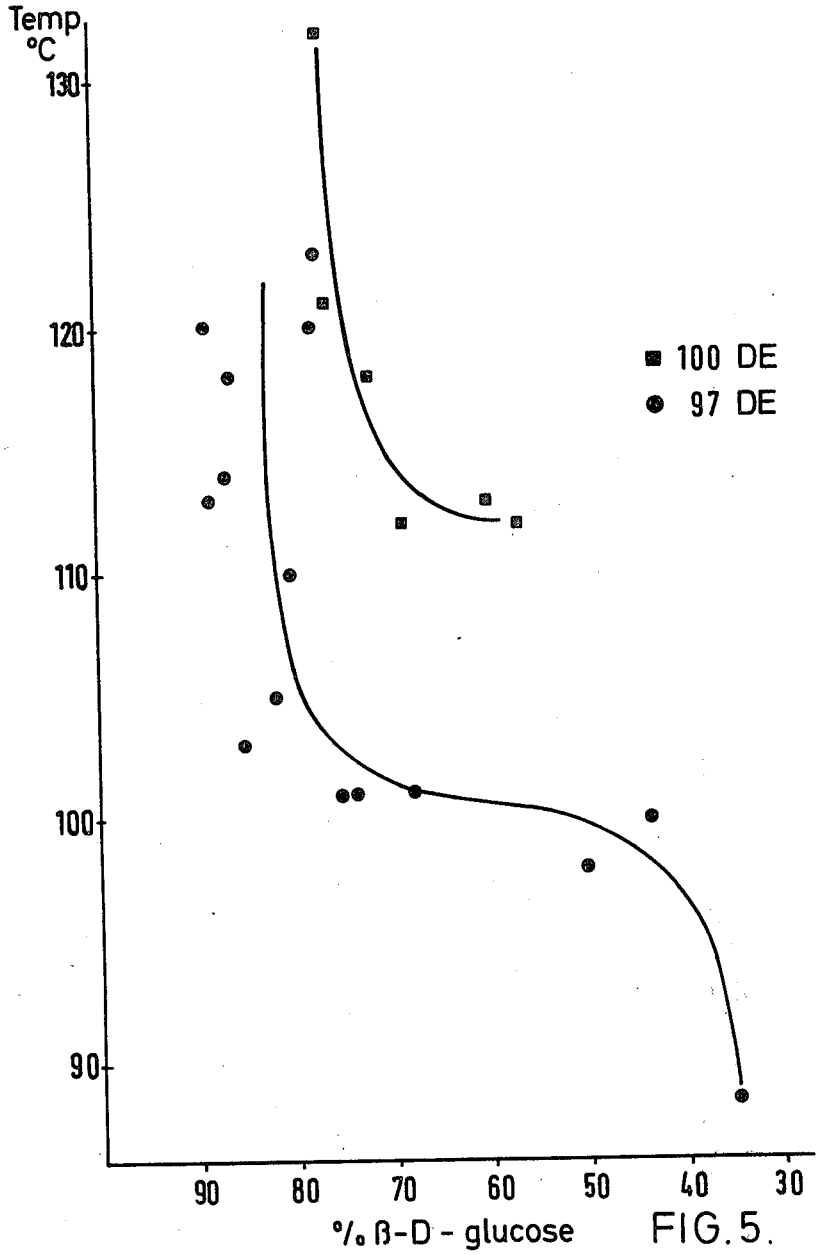
FIG. 5 is a graph of the temperature of the evaporated syrup plotted against the amount of β-isomer in the crystallised product.

From FIG. 5, it will be seen that the commercial syrup required a lower temperature than the dissolved dextrose in order to give microcrystals of a given β-content. Whereas the commercial syrup gives high β-contents at around 101° C., the dextrose required a temperature of about 114° C. or more. For either liquid, the β-content increased with temperature until the maximum β-content was attained.

I claim:

1. A process for the production of crystalline glucose from a glucose syrup, comprising the steps of (1) evaporating water from the glucose syrup at a pressure of less than 400 mm Hg to provide an at least 60% supersaturated solution of greater than 95% solids at a temperature of from 95° to 140° C.;

(2) subjecting the supersaturated solution to a shear force for less than 0.5 second to cause immediate nucleation of the syrup without cooling; and (3) immediately forming the nucleated but substantially uncrystallised syrup into a quiescent layer and allowing the layer to crystallise substantially isothermally to produce solid crystalline glucose.

2. A process according to claim 1, wherein the glucose solution is at least 70% supersaturated.

3. A process according to claim 2, wherein the glucose syrup is of 98–100 DE and is evaporated at a temperature of from 110° to 130° C.

4. A process according to claim 3, wherein the temperature is 115° to 125° C.

5. A process according to claim 2, wherein the glucose syrup is prepared by hydrolysis of starch to a DE of 93–98 and is evaporated at a temperature of from 105° to 125° C.

6. A process according to claim 5, wherein the temperature is 10° to 120° C.

7. A process according to claim 1 wherein the glucose syrup is evaporated at 100 to 150 mm Hg.

8. A process according to claim 7 wherein the evaporation gives a solution of 98 to 99% solids.

9. A process according to claim 1 wherein the process is operated so as to attain "steady state" conditions, whereby the temperature of the syrup leaving the evaporator and the temperature of the syrup in the shearing equipment remain constant and are substantially the same.

10. A product produced by the process of claim 1 comprising microcrystals of a mixture of $\alpha$- and $\beta$-forms of glucose, at least 70% of the glucose being in the form of the $\beta$-isomer, wherein the microcrystals each have a maximum dimension of less than 50 microns.

11. A product according to claim 10, wherein the microcrystals form part of an agglomerate or other composite structure.

12. A product according to claim 10 in which the maximum dimension is less than 10 microns.

13. A product according to claim 10 wherein at least 85% of the glucose is the $\beta$-isomer of D-glucose.

* * * * *